United States Patent [19]

Bolza-Schünemann

[11] Patent Number: 4,508,034

[45] Date of Patent: Apr. 2, 1985

[54] CONTROL MECHANISM TO DISABLE DRIVEN INK METERING ELEMENTS IN ROTARY PRINTING MACHINES

[75] Inventor: Claus A. Bolza-Schünemann, Würzburg, Fed. Rep. of Germany

[73] Assignee: Koenig & Bauer Aktiengesellschaft, Würzburg, Fed. Rep. of Germany

[21] Appl. No.: 575,726

[22] Filed: Feb. 2, 1984

Related U.S. Application Data

[63] Continuation of Ser. No. 300,854, Sep. 10, 1981, abandoned.

[30] Foreign Application Priority Data

Dec. 9, 1980 [DE] Fed. Rep. of Germany ..... 3034417

[51] Int. Cl.[3] ..... B41F 31/30

[52] U.S. Cl. ..... 101/365; 101/DIG. 26

[58] Field of Search ..... 101/365, DIG. 26; 340/147 R

[56] References Cited

U.S. PATENT DOCUMENTS

| | | | |
|---|---|---|---|
| 2,497,648 | 2/1950 | Worthington | 101/365 |
| 3,236,178 | 2/1966 | Worthington et al. | 101/365 |
| 3,608,486 | 9/1971 | McDonald et al. | 101/365 |
| 3,702,587 | 11/1972 | Lee | 101/365 |
| 3,707,123 | 12/1972 | Heasman et al. | 101/365 X |
| 3,835,777 | 9/1974 | Krygeris | 101/365 |
| 4,281,597 | 8/1981 | Dressler | 101/365 |

FOREIGN PATENT DOCUMENTS

| | | | |
|---|---|---|---|
| 2000082 | 1/1979 | United Kingdom | 101/365 |
| 2007594 | 5/1979 | United Kingdom | 101/365 |

*Primary Examiner*—Paul T. Sewell
*Assistant Examiner*—John A. Weresh
*Attorney, Agent, or Firm*—Jones, Tullar & Cooper

[57] ABSTRACT

A control mechanism for disabling selected driven ink metering elements in rotary printing machines from a central remote control station is disclosed. The control includes plural command switches which are operated to provide control signal inputs to a programmable microprocessor. The microprocessor is connected to the drive circuits for the individual ink metering elements to position them in response to the selected control signals to increase or decrease the amount of ink supplied by each element individually or jointly, and to disable selected ink metering elements by moving them to a zero position so as to select the width of the printing area.

7 Claims, 1 Drawing Figure

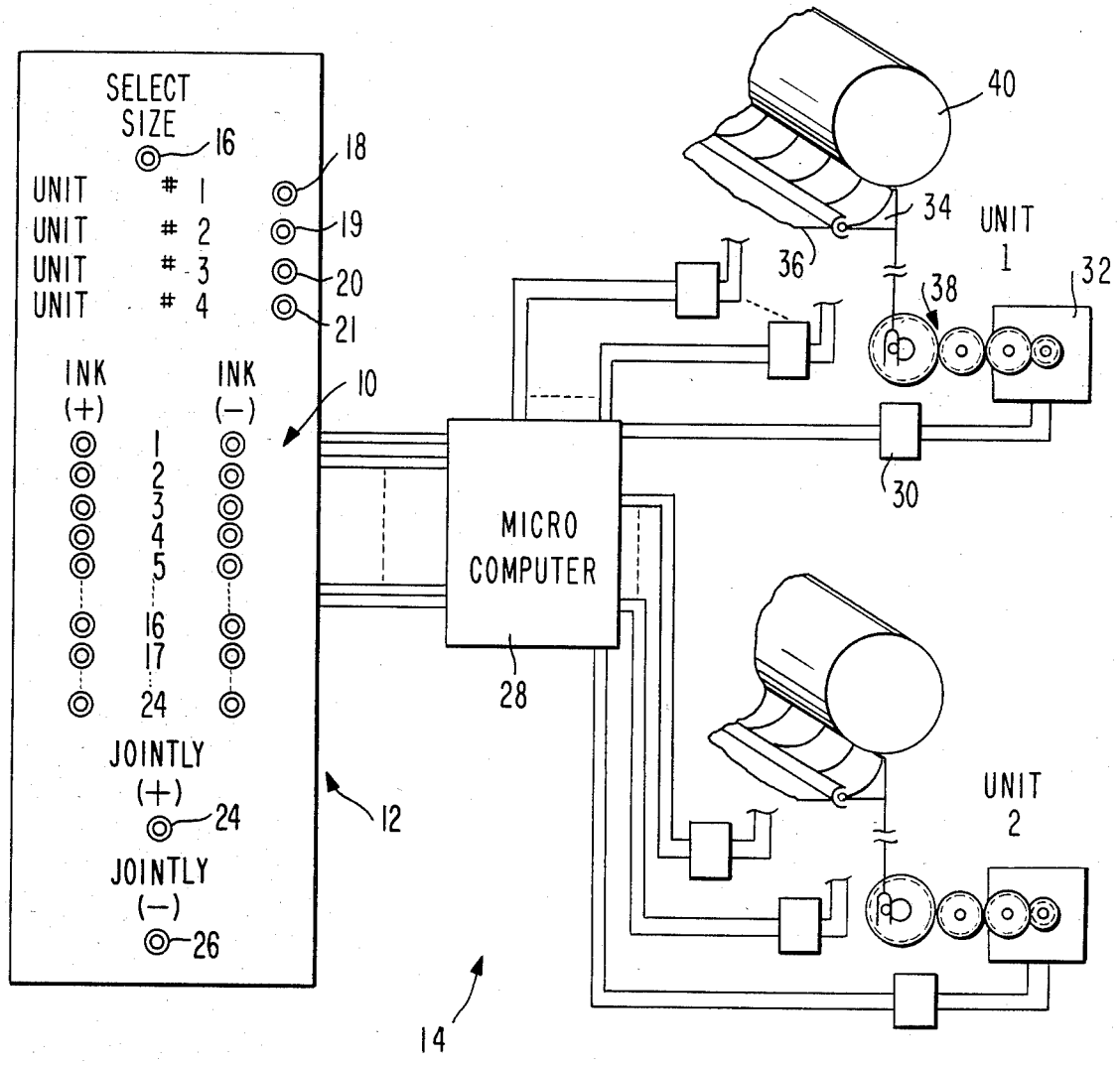
SELECT SIZE
16
18
UNIT # 1
UNIT # 2
UNIT # 3
UNIT # 4
19
20
21
INK (+)
INK (−)
10
1
2
3
4
5
16
17
24
JOINTLY (+)
24
JOINTLY (−)
26
12
MICRO COMPUTER
28
40
34
36
38
UNIT 1
32
30
UNIT 2
14

CONTROL MECHANISM TO DISABLE DRIVEN INK METERING ELEMENTS IN ROTARY PRINTING MACHINES

This application is a continuation of application Ser. No. 300,854, filed Sept. 10, 1981, now abandoned.

FIELD OF THE INVENTION

The present invention is directed to a control mechanism to disable driven ink metering elements and more particularly to a control mechanism operable through a programmable microprocessor to regulate the positions of individual ink metering elements in a rotary printing machine.

DESCRIPTION OF THE PRIOR ART

It has become known in the art to control ink metering elements of inking units electrically, either individually or jointly, from a remote control station. For any modification of the width of a printing area, it is necessary to add or to remove ink zones. For removal of such a zone, it is expedient to interrupt the ink supply from those areas of the ink fountain width projecting beyond the width of the desired printing area, and this is accomplished by causing such ink metering elements to move into contact with the ink fountain roller. Possibly the case may arise, however, that all ink metering elements of an ink fountain must jointly supply, for example, 10% more ink. As a rule, this is done by operating a single push button in the remote control location which simultaneously transmits control commands to all drives for the ink metering elements.

These control commands are transmitted for the duration of time required to jointly open all ink gaps an equal amount. In prior control arrangements, such commands are also transmitted to those ink metering elements which are not required, for example, due to the small width of printing area, and whose opening is therefore detrimental. Analogous to this is the case in multi-color rotary printing machines, in which not all ink metering elements of all inking units are required because of the unequal ink distribution over the whole width of printing area, and in which nonutilized ink metering elements are adjusted with respect to the ink fountain roller so that the ink gaps of these nonutilized ink metering elements are essentially zero. Since all ink metering elements are jointly adjusted when the quantity of ink supply is increased as a whole, in such prior control arrangements, the operators have to readjust each individual ink metering element which is not required to its "Ink Zero" position.

SUMMARY OF THE INVENTION

It is an object of the present invention to provide a mechanism permitting any ink metering element which is driven by an electric motor from a remote control station to be rendered inactive in a simple way, so that is is not operated with other ink metering elements in case of a general ink metering element adjustment.

Briefly, the invention comprises a control mechanism for disabling selected motor-driven ink metering elements so that such elements are not adjusted when there is a control command to adjust all metering elements. The control mechanism includes plural command switches, in the form of manually operable push buttons which are activated by an operator to provide metering element control signal inputs to a programmable microprocessor. The outputs of the processor are motor control signals which are connected to corresponding drive circuits for the individual ink metering elements of an ink fountain to position the individual elements. The microprocessor responds to its input signals to produce suitable command signals which increase or decrease. The amount of ink supplied by each element individually or jointly and to disable selected ink metering elements by moving them to a zero position. These disabled elements are selected to define the width of the printing area, and are not moved when a joint adjustment of all the elements is commanded.

BRIEF DESCRIPTION OF THE DRAWINGS

The foregoing objects, features and advantages of the invention will become apparent from the following more detailed description of a preferred embodiment thereof, taken in conjunction with the single FIGURE of the accompanying drawing, which is a diagrammatic illustration of the control system of the invention.

DESCRIPTION OF THE PREFERRED EMBODIMENT

Referring now to the single FIGURE of the drawings, a plurality of manually operable metering element control switches such as push buttons 10 are disposed side by side on a control panel 12 located at a convenient remote control station from which the operation of ink metering elements for a conventional rotary printing press 14 are controlled by an operator, in a manner known in the art. A pair of push buttons 10 is provided for each ink metering element; for example, 24 push button pairs for one ink fountain of one inking unit. Each pair includes one "+" push button (="Increase Ink") and one "−" push button (="Reduce Ink"), so that two push buttons are provided for each ink metering element, as illustrated in the drawing.

A "Select Size" push button 16 is also provided on the control panel, as well as a plurality of "Printing Unit" push buttons, the number required depending upon the number of printing units in the rotary printing press 14. In the example illustrated, the press 14 includes 4 printing units, requiring push buttons 18–21 for "Printing Unit 1", "Printing Unit 2", "Printing Unit 3", and "Printing Unit 4", respectively. A "Jointly-Increase Ink" push button 24 ("Jointly +") and a "Jointly Reduce Ink" push button 26 ("Jointly −") are also provided at control panel 12.

Each of the push buttons on panel 12 is connected to a micro computer system such as microprocessor 28, which transmits control commands to corresponding electronic counters and control cards 30. Each control cards serves as a control unit for a stepping motor 32 which drives a corresponding ink metering element 34 of ink fountain 36. The metering element is driven through suitable gears 38, in the manner described in greater detail in copending U.S. application Ser. No. 300,853 of Erich Georg Wieland, entitled "Method and Control Device to Indicate Adjusting Values for Ink Fountains or Damping Units Respectively in Rotary Printing Machines", and filed on even date herewith. It will be understood that each printing unit includes an ink fountain roller 40 and an ink fountain 36, and that a plurality (for example 24) of metering elements 34 are provided for each ink fountain, with each metering element being driven individually by a corresponding stepping motor.

If, for example, in the operation of the printing press 14, ink metering element No. 17 of inking unit 2 requires additional ink, the inking unit 2 is selected by means of the push button 19 "Inking Unit 2", and the "+" push button coordinated to the ink metering element No. 17 is operated. The corresponding stepping motor 32 adjusts the selected ink metering element 34 in accordance wih the duration of operation of the relative "+" push button. Analogous measures are taken to select an ink metering element in the sense of "Reduce Ink" by operating the respective "−" push button. Every controllable position of the ink metering element is stored in an electronic storage, capable of being selected, and is indicated in a visual indicator means in the remote control station when being selected, in the manner described in the above-mentioned U.S. application Ser. No. 300,853, of Erich Georg Wieland.

If the size of the printing area is to be modified in its width, the push buttons 16, 18, and 19, corresponding to "Select Size" and "Inking Unit 1", "Inking Unit 2" are operated. If a four-color printing machine is concerned, the push buttons 20 and 21, "Inking Unit 3" and "Inking Unit 4" are also operated. By operating the push buttons "Select Size" and "Inking Unit 1" to "Inking Unit 4", the instruction is stored in microprocessor 28 for whichever inking units a modification of size is to be effected. Subsequently the "−" push buttons are operated for those inking metering elements which are not required for the size to be printed, and which therefore, are to be disabled. As a result of these commands, the respective stepping motors 32 move every ink metering element 34 concerned into a zero position on the ink fountain roller 40 coordinated to it; that is, the printing ink supply in the selected inking unit is stopped in these ink zone areas. If a smaller width of printing area is to be changed over to a larger one, the respective "+" push buttons must be operated. Then the stepping motors concerned move their ink metering elements into preselectable positions with respect to the ink fountain roller.

After termination of the selection of size, for example the push button 16 "Select Size" is operated once more to achieve storage of the size selection in the micro computer 28. If subsequently the push button 24 "Jointly−Increase Ink" ("Jointly +") or the push button 26 "Jointly−Reduce Ink" ("Jointly −") is operated, all ink metering elements coordinated to the adjusted size area only—that is, only the active ink metering elements—are jointly adjusted for an equal amount in accordance with the duration of the push button operation in the preselected sense ("+" or "−").

It is furthermore possible at any time to move any ink metering element in any inking unit for the required duration of time into a zero position with respect to the ink fountain roller by a first step of selecting the required inking unit through the push buttons "Inking Unit 1" to "Inking Unit 4"; subsequently the respective "−" push button is operated twice, storing this command with the result that this ink metering element concerned is temporarily rendered inactive. The neutralization of the zero position is effected by analogy by the double operation of the "+" push button.

I claim:

1. In a control mechanism for disabling selected driven ink metering elements in rotary printing machines from a remote control station, which metering elements cooperate with an ink fountain roller, comprising:

at least one ink fountain roller having an ink fountain;

a plurality of ink metering elements for said ink fountain, said ink metering elements being individually adjustable to control the flow of ink from said fountain to said roller;

a plurality of drive motors, each drive motor being connected to drive an individual corresponding ink metering element in response to a motor control command signal;

a program-controllable micro computer having control inputs and output means providing command output signals;

a remote control panel having selectable command control means including a "Reduce Ink" command push button and an "Increase Ink" command push button for each ink metering element, an "Inking Unit" command push button for each ink fountain roller in the rotary printing machine for selecting an inking unit to be controlled, a "Select Size" command push button, a "Jointly-Reduce Ink" command push button, and a "Jointly-Increase Ink" command push button;

means connecting said push buttons to corresponding control inputs to said micro computer;

means connecting said output means of said micro computer to corresponding drive motors, to provide selectable motor control command signals to said drive motors, said micro computer being operable selectively to position individual metering elements in response to operation of corresponding push buttons, whereby after operating said "Select Size" push button and a selected "Inking Unit" push button and subsequently operating a "Reduce Ink" push button for at least one selected adjustable metering element, all selected metering elements are adjusted to a zero gap position with respect to their corresponding ink fountain roller, wherein ink metering elements adjusted into a zero position are placed in an inactive status with respect to any subsequent operation of said "Increase Ink", "Reduce Ink", "Jointly-Increase Ink", and "Jointly-Reduce Ink" push buttons, unless said inactive status is released by subsequent operation of said "Select Size" push button.

2. A method for controlling individual ink metering elements of an ink fountain for a rotary printing press unit, comprising:

driving each individual ink metering element by means of a corresponding individual drive motor connected to the metering element;

selectively controlling each individual drive motor to move its corresponding element individually or controlling all of said drive motors jointly to move all corresponding elements jointly to selectively increase or reduce the ink metered by said elements;

selectively sizing said rotary printing press unit, the step of sizing including (a) engaging a sizing control, and selectively operating the drive motor of at least one ink metering element to cause any said selected element to move to its zero position to prevent the flow of ink to the area of said rotary printing press unit corresponding to the said selected element when it is desired to reduce the size of said printing press unit, and (b) engaging said sizing control, and selectively operating the drive motor of at least one ink metering element to cause any said selected element to move to a predetermined open position to permit a flow of ink to the area of said rotary printing press corresponding to the said selected element when it is desired to increase the size of said printing press unit;

disengaging said sizing control to disable the drive motor of any ink metering element at the zero position to thereby prevent further operation thereof until a further sizing step is effected; and thereafter controlling only non-disabled drive motors either individually or jointly to selectively increase or reduce the flow of ink metered by elements driven by nondisabled drive motors.

3. A control mechanism for controlling from a central remote control station selected motor-driven ink metering elements which cooperate with, and control, the flow of ink to ink fountain rollers in a rotary printing machine, comprising:

at least one ink fountain roller having an ink fountain;

a plurality of ink metering elements for said ink fountain, said ink metering elements being adjustable between a zero gap and a full flow position to control the flow of ink from said fountain to said roller;

a plurality of drive motors, each drive motor being connected to drive a corresponding one of said ink metering elements selectively to increase or reduce the flow of ink in response to motor control command signals;

a micro computer having control inputs and command outputs, said command outputs being connected to provide said motor control command signals to said drive motor means;

a control panel having a plurality of control switches connected to said micro computer control inputs for selectively actuating said drive motors by way of said micro computer, said control panel including:

reduce ink control switch means and increase ink control switch means for each of said ink metering elements for causing individually selected drive motors to adjust their corresponding ink metering elements toward their zero gap positions and toward their full flow positions, respectively;

inking unit control switch means corresponding to each ink fountain roller in the rotary printing machine for selecting an inking unit to be controlled by said reduce ink and increase ink control switch means;

jointly-reduce ink and jointly-increase ink control switch means adapted normally to activate all said drive motors simultaneously to adjust their corresponding ink metering elements toward their zero gap positions and toward their full flow positions, respectively;

select size control switch means cooperable with said reduce ink control means and said increase ink control means to disable selected drive motors, the operation of said select size control switch means and subsequent operation of one or more selected reduce ink control means causing each selected drive motor to drive its corresponding ink metering element to its zero position to disable it, whereby all disabled zero-position ink metering elements remain disabled until re-enablement by a subsequent operation of said select size control switch followed by operation of the increase ink control means corresponding to the ink metering elements to be re-enabled, all disabled ink metering elements being removed from the control of said jointly-reduce and jointly-increase ink control switch means.

4. The control mechanism of claim 3, wherein each of said drive motors is a stepping motor responsive to the command outputs of said microcomputer.

5. The control mechanism of claim 4, further including respective gear means interconnecting each said drive motor to its corresponding ink metering elements.

6. The method of claim 2, wherein the step of driving each ink metering element comprises driving each element incrementally by means of corresponding stepping motor.

7. The control mechanism of claim 1, wherein each of said plurality of drive motors is a stepping motor connected to drive its corresponding ink metering element in incremental steps to adjust the flow of ink therefrom.

* * * * *